United States Patent [19]

Grabher

[11] Patent Number: 4,842,468

[45] Date of Patent: Jun. 27, 1989

[54] PROCESS FOR FORMING A CLOSURE DIAPHRAGM FOR A CONTAINER

[75] Inventor: Werner Grabher, Au, Switzerland

[73] Assignee: Grabher Indosa-Macschinentou AG, Au-SG, Switzerland

[21] Appl. No.: 125,370

[22] Filed: Nov. 25, 1987

Related U.S. Application Data

[63] Continuation of Ser. No. 883,306, July 8, 1986, now U.S. Pat. No. 4,744,484

[30] Foreign Application Priority Data

Jul. 10, 1985 [CH] Switzerland ..... 2995/85

[51] Int. Cl.[4] ..... B21D 51/26

[52] U.S. Cl. ..... 413/12; 413/2

[58] Field of Search ..... 413/2, 4, 6, 15, 17, 413/12; 220/276, 270, 269, 281, 266, 258, 89 A; 215/253, 250, 255, 256

[56] References Cited

U.S. PATENT DOCUMENTS

| | | | |
|---|---|---|---|
| 3,741,142 | 6/1973 | Stuard | 413/17 |
| 3,746,202 | 7/1973 | Moller | 215/253 |
| 3,859,942 | 1/1975 | Moller | 413/10 |
| 4,212,409 | 7/1980 | Jeppsson | 220/276 |
| 4,333,585 | 6/1982 | Del Bon | 220/276 |
| 4,433,793 | 2/1984 | Ingemann | 220/276 |
| 4,691,834 | 9/1987 | Bullock | 220/270 |

*Primary Examiner*—Daniel C. Crane

*Attorney, Agent, or Firm*—Cushman, Darby & Cushman

[57] ABSTRACT

Can-like containers are frequently closed or sealed with a diaphragm, the wall of which is provided with severance points, or the part of which that is U-shaped in cross section (3) covering the cut edge (15) of the can wall (17) is already located at least partially at a distance (a) from the nearly dish-shaped closure part (14). The diaphragm (14) according to the present invention has severance points that are formed by narrow ligaments (4) interrupted by cut-outs (5), said ligaments being arranged alternatingly along a circumferential line in the rim (2) of the diaphragm. A diaphragm for the closing of can-like containers is e.g. fabricated in that the foil is deep-drawn, and in the end phase of the closing movement cut-outs (5) are formed in its rim (2) by shearing edges (8 and 11). At least one shearing edge (8) is interrupted by notches (9), in the area of which ligaments (4) remain.

1 Claim, 4 Drawing Sheets

Figure 4:
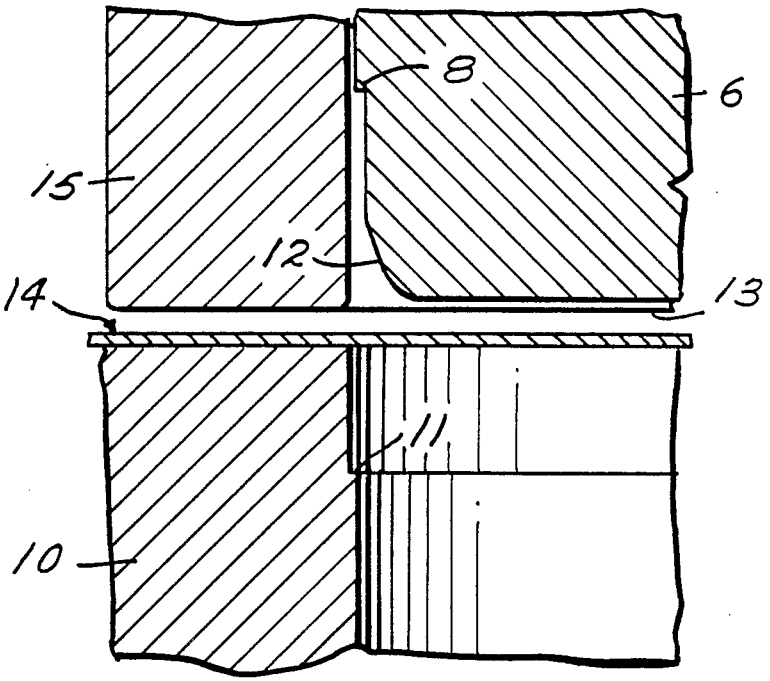

Fig. 2.
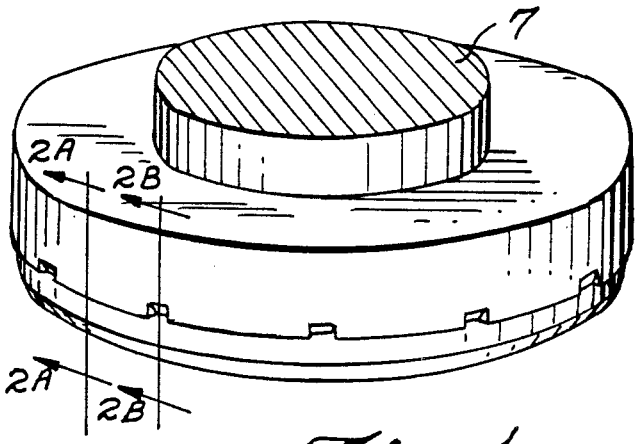
Fig. 1
Fig. 2A.
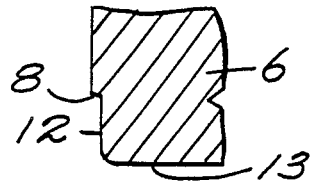
Fig. 2B.
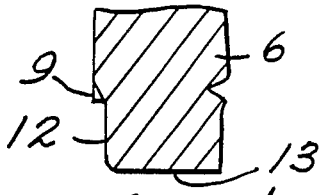
Fig. 1A.
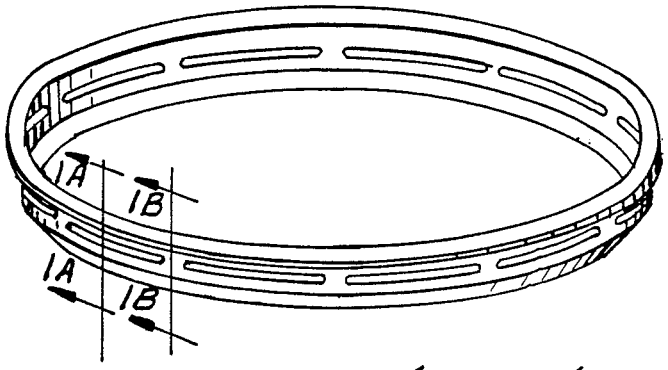
Fig. 3.
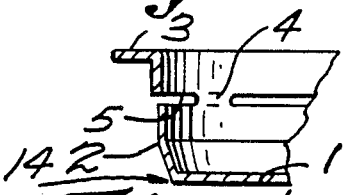
Fig. 1B.
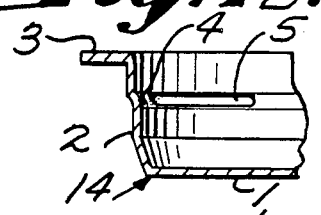
Fig. 3A.
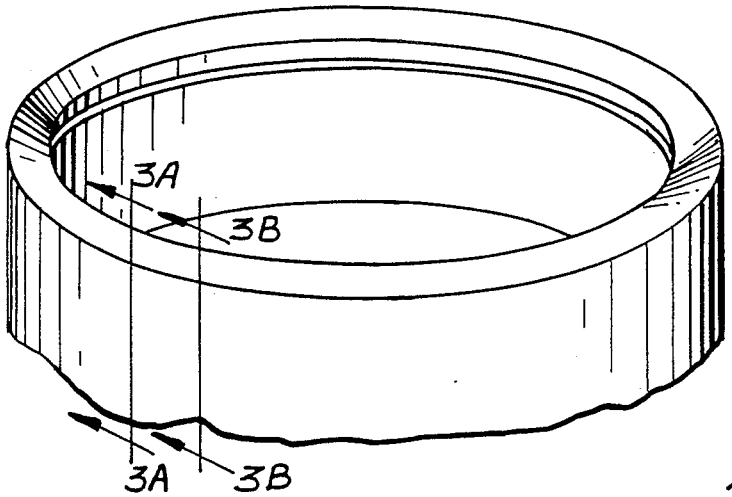
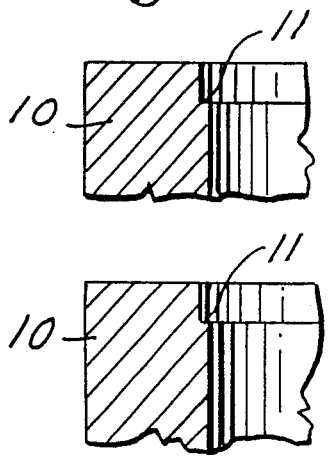
Fig. 3B.

PROCESS FOR FORMING A CLOSURE DIAPHRAGM FOR A CONTAINER

This is a continuation of application Ser. No. 883,306 filed July 8, 1986, now U.S. Pat. No. 4,744,484.

The invention relates to a can to a process for manufacturing the can; to a diaphragm for the closing and sealing thereof; and finally to a device for the manufacture of the diaphragm.

The aformentioned can is described in EU-A 007 487, but in practice it has never become known because on the one hand the process described for the manufacture thereof required too great an effort, and on the other hand it did not function at all. Namely, in the aforementioned letters patent it was proposed that the collar part of the closing diaphragm to first be reduced in thickness or perforated by means of hard pressing surfaces along a circumferential line to serve later as a severance point, then to insert the diaphragm in the can opening, to heat it and to separate the diaphragm collar and the edge covering by the application of a pressure acting radially to the outside, along or next to the severance line. Apart from this process, which is complicated and susceptible to trouble, in practice a really complete separation of the two diaphragm parts has never been achieved, so that when the can was opened by tearing open the diaphragm dish, parts of the covering part were always pulled out along with the dish and frayed. Hence, precisely the effect occurred that the invention intended to avoided.

Another proposal is described in DE-A 32 12 990, but it could also not be realized in practice. There, the diaphragm consists of two layers; only the inner layer of the diaphragm dish rim is separated from the attendent edge covering, while the outer layer enwraps the dish and the edge covering without injury and serves for teering open. It is as good as impossible to match the adhesive strength of the inner layer on the inside of the can to that of the two foils such that the effect that is endeavored by the invention is achieved - this due to contradictory requirements: in the dish area the adherence of the two foils on top of one another must be greater that the adherence of the collar of the inner layer on the inside of the can; in the coverage area it would have to be exactly the opposite in order that the inside foil covers the cut edge of the wall of the can with surety even after the tearing open.

The invention therefore has as its objective to devise a can of the type mentioned above that avoids the aforementioned disadvantages and that can be realized in practice. This is accomplished by the measures described herein. A can design in such a manner can be manufactured easily and poses no tearing-open problems, but rather leaves a smooth and clean covered part.

In accord with a further objective of the invention a process is to be devised with which the can can be closed and sealed in as simple a manner as possible, preferably in a single production operation, while achieving the endeavored advantages. This is accomplished by the measures defined herein.

It is moreover the objective of the present invention to devise a diaphragm for closing and sealing cans or similar containers that can be made in a single operation, and that still provide easy opening by means of suitable severance points. This objective is achieved by the present invention by means of cut-outs and ligaments being provided alternatingly in the wall along a circumferential lines.

Finally, it is the objective of the present invention to devise a process and a device for the rational manufacture of the diaphragm according to said invention that is used for making a can that is closed and sealed according to the present invention.

A ligament in the diaphragm according to the present invention has a length of about 1 to about 30%, preferably 3 to 20%, especially 5 to 15% of the cut-out, preferably 6 to about 12, especially 8 to 10 cut-outs and ligaments being provided, depending on the diameter of the diaphragm. Fewer (longer) cut-outs and/or shorter ligaments endanger the workability of the diaphragm when it is being glued into the can because the long cut-outs tend to pull apart. More (shorter cut-outs and/or longer ligaments incur greater problems on tearing open. The correct selection can easily be made by any person skilled in the art in function especially of the diaphragm material thickness and stiffness, as well as of the tolerances of the can.

In order that the diaphragm can be sealed in the can dependably it is expedient for the severance line to extend above half height of the wall, e.g. in the upper third thereof. To facilitate the tearing of the ligaments during the sealing they are preferably already pre-bent and/or even reduced in thickness—at least over a part of their width—so that they form severance points that actually tear on the application of pull, while retaining the sealing of the edge covering. It is especially expedient for the ligament to have a nearly fusiform cross-section by their two ends at the ends bordering on the respective cut-outs being crushed or slit to zero thickness.

In order to be able to manufacture such a diaphragm with an integral severance point in a simple manner, according to a further embodiment of the invention a deep-drawing die and a matrix are used, each having a shearing edge all round for making the cut-outs. At least the shearing edge of one part of the tool is interrupted on the circumference, preferably at uniformly distributed locations.

On the basis of an embodiment the invention is described in detail. Shown are:

FIGS. 1, 1A and 1B a finished diaphragm

FIGS. 2A and 2B the deep-drawing die

FIGS. 3, 3A and 3B the attendant matrix

FIGS. 4 the tool in the open position in the cut-out area

Figure 5:
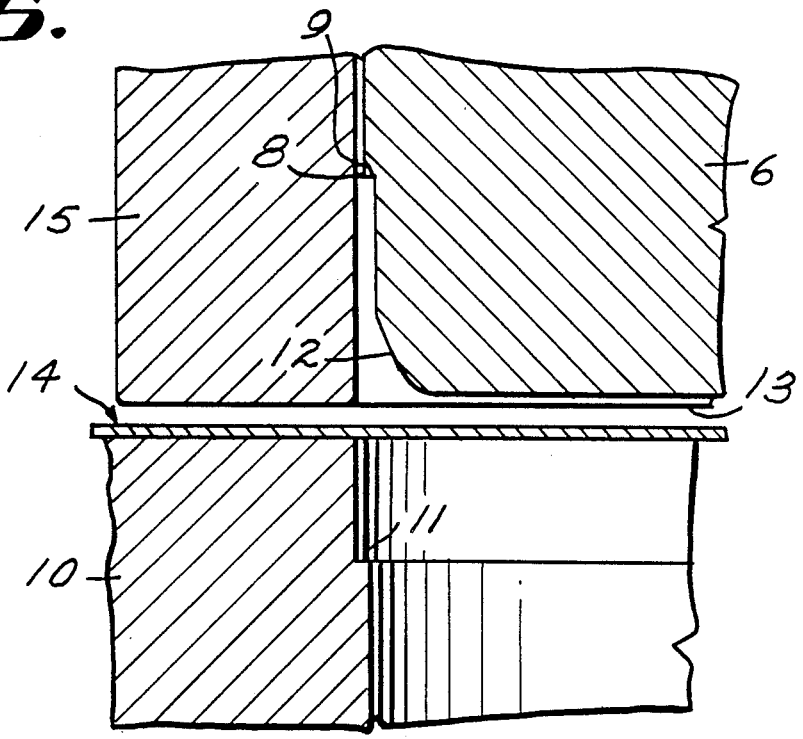

FIG. 5 the tool in the open position in the ligament area

Figure 6:
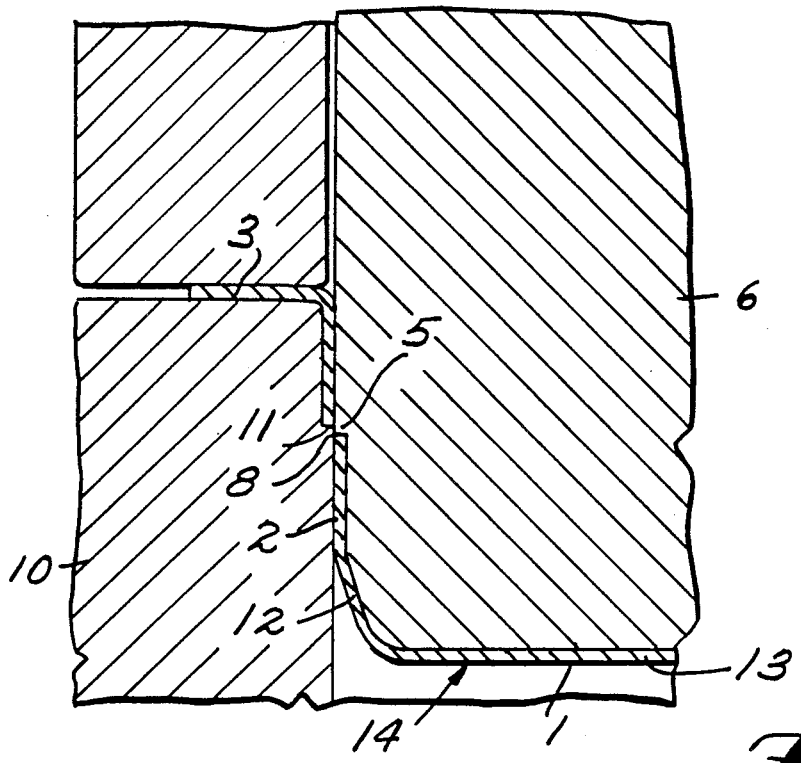

FIG. 6 the tool in the closed position in the cut-out area

Figure 7:
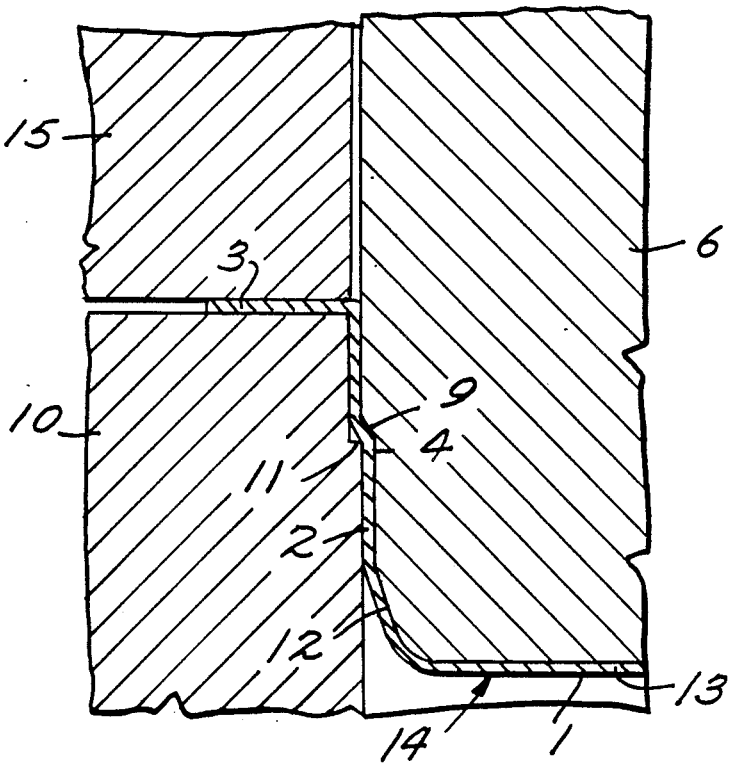

FIG. 7 the tool in the closed position in the ligament area.

Figure 9:
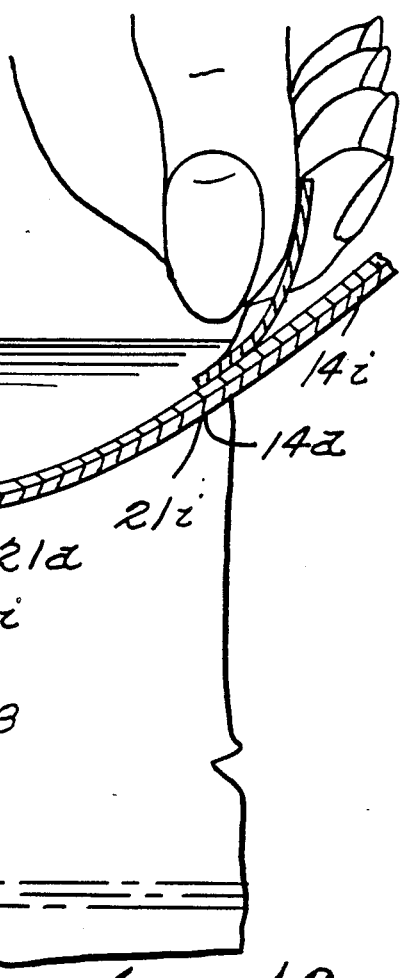
Figure 8:
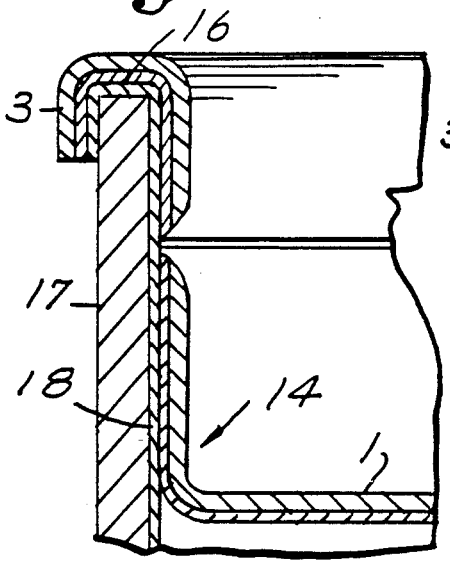
Figure 10A:
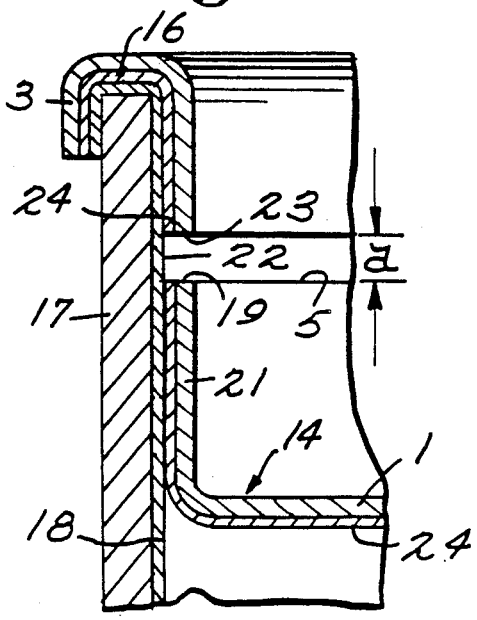
Figure 10B:
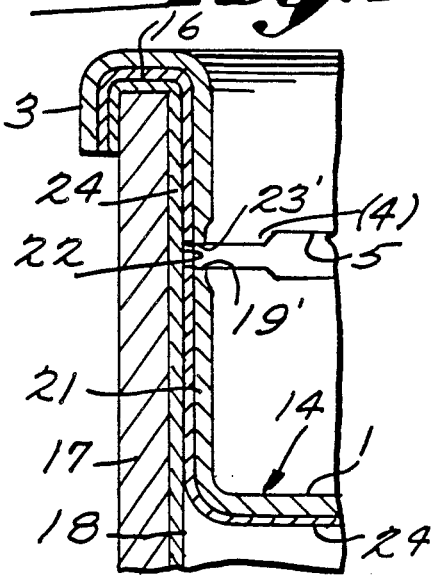

FIGS. 8 and 9 a cross sectional elevation of the end of a can wall closed with a membrane in the conventional manner; and FIGS. 10, 10A and 10B a cross-section through end of a wall of a can according to the present invention in the area of a cut-out (10*a*) and of a ligament (10*b*).

FIG. 1 shows a perspective view of a finished (circular) diaphragm 14 (for a can with a round cross section). The diaphragm consists of dish 1, the rim 2, as well as the radially projecting flange 3. The elongate slots 5 distributed uniformly on the circumference and limited by the ligaments 4 are arranged in the upper third of the wall 2. Sections A and B, shown in a figure, are also indicated (FIG. 1A, FIG. 1B). The arrangement of the elongate slots 5 and the ligaments 4 are shown. The diaphragm material can be of a thickness of e.g. 40 to 60 microns.

From FIG. 2 the deep drawing die 6, as well as it areas A and B, are shown. At the top the deep drawing die 6 has a shaft 7 for clamping in the tool. The die itself is a disk-like part of the tool with a drawing radius 12 on the circumference of the face 13; the cylindrical drawing edge ends in a shearing edge 8, which is arranged in the areas A and is shown in the associated cross-sectional view (FIG. 2A). The notch 9 is in the areas B. Here, only the shearing edge 8 is interrupted, namely with a depth of about 100 microns and an inclination of 25° to 60° seen from the longitudinal axis. The width of the notch 9 corresponds to the desired width of a ligament 4.

FIG. 3 shows the matrix 10. This matrix is an annular tool with a shearing edge 11 on its inside that can be provided with interruptions, which however are not shown in FIG. 3. This can also be recognized by virtue of the fact that the cross-sections A and B (FIG. 3A, FIG. 3B) are identical.

FIGS. 4 and 5 show the tool in the open position. The diaphragm foil 14, which is prepared in the form of a flat disk, is on top of the matrix 10. The holddown device 15 guided by the die 6 is in the form of a ring. Here too the drawing contour 12 can be recognized, the shearing edge 8 being shown in FIG. 4, whereas the notch 9 in FIG. 5 represents the interruption of the same.

FIGS. 6 and 7 show the tool in the closed position. On lifting the matrix first hits the holddown device 15 and immediately thereafter enclasps the deep drawing die 5. The diaphragm foil 14 is now converted into the dish 1, the rim 2 and the flange 3. FIG. 6 shows that the finished diaphragm is cut open on the side. This corresponds to point A in FIG. 1. This is different in FIG. 7, where the cut was interrupted by notch 9, thereby producing only a crimping in the wall 2 of the diaphragm foil 14.

The manufacture is effected in the manner that when the tool is closed first dish 1, rim 2 and flange 3 are shaped, while at the same time the rim 2 experiences a Z-shaped configuration in cross-section, and in the end phase of the closing movement the elongate slots 5 are cut by shearing edges 8 and 11.

In manufacturing a container using the diaphragm of the present invention, the diaphragm as manufactured in placed on the can wall 17 and held in position with the aid of die means while the dish of the diaphragm is forced a distance into the can until the ligaments 4 are torn.

Essential is that the shearing edges 8 and 11 have an only slight overlap, namely in the order of 100 to 200 microns, which assures that the diaphragm can be fabricated in a single production operation, the elongate slots 5 being cut and the ligaments 4 crimped or bent and eventually even—at least partiallly—reduced in cross-section, thereby forming the desired severance points.

To be regarded as especially important however is the fact that only a single operation suffices to fabricate this diaphragm, and that the use of further machines is not required. Existing tools can eventually be converted by the fitting of shearing edges 8 and notches 9.

As mentioned above, a can closed in the conventional manner according to FIG. 8 does not achieve a separation of the edge covering 3 from the closure part 14 over the circumference in the area relevant for the invention.

Moreover, the conventional diaphragm according to FIG. 9 suffers from the fact that the adherence of the two diaphragm layers in the edge covering area (3*a*, 3*i*) would have to be lower than in the vertical (21*a*, 21*i*) and horizontal (14*a*, 14*i*) closure area.

Conversely, the open end 16 of the finish-closed can 17 according to the present invention as per FIG. 10 (FIG. 10*a*, FIG. 10*b*) is enclasped by the now separated, annular flange 3 of the diaphragm 14. The upper end 19, 19′ of the cylindrical wall 21 is arranged at a short distance a from the lower end 23, 23′ of the inside leg of the flange 3, the distance being just large enough for the earlier severance points 4 (FIG. 1) to be torn. Namely, subjected to pull, clean tearing will usually occur as opposed to the conventional peeling when the can is opened, in which case the inside leg of the flange 3 can frequently be frayed as is mentioned above. For this reason a diaphragm other than the one according to the present invention, insofar as it has only a severance point extending over the circumference of its cylindrical wall part, can also eventually be used for the manufacture of the can according to the present invention, even though because of its easy manuacturability the diaphragm according to the present invention is preferred.

During the closing and tear-off operation the heat-sealing layer 24 adheres to the inside lining 18 of the can, of which an uninjured circumferential strip 22 is retained after the ligaments 4 (FIG. 1) are torn through.

I claim:

1. In a process for forming a closure diaphragm for a container of the type having a body having an edge surrounding an opening in said body with die means the diaphragm being of the type having a dish portion including a peripheral wall having a rim with said wall having a plurality of slits extending along a circumferential line and separated by ligaments, said rim terminating in a radially extending flange shaped to engage said edge of said body, comprising the steps of:

(a) moving said dish into said opening with said die means until said flange engages said edge of said body of said die means, (b) holding fast said flange on said edge, and (c) subsequently continuing to move said dish into said opening to sever said ligaments and disconnect said dish portion from said flange.

* * * * *